United States Patent [19]

Graham et al.

[11] 4,195,212

[45] Mar. 25, 1980

[54] CONTACTOR HAVING HIGHER FAULT CURRENT WITHSTANDABILITY

[75] Inventors: Robert O. Graham, Milwaukee; John A. Rauenbuehler, New Berlin; Albert C. Snowdon, Shorewood, all of Wis.

[73] Assignee: Eaton Corporation, Cleveland, Ohio

[21] Appl. No.: 803,759

[22] Filed: Jun. 6, 1977

[51] Int. Cl.[2] ..... H01H 1/20; H01H 1/50; H01H 3/60

[52] U.S. Cl. ..... 200/243; 200/288; 200/250; 335/127

[58] Field of Search ..... 200/252, 250, 245, 243, 200/239, 252, 250, 288; 335/127, 129, 132, 133, 188, 201

[56] References Cited

U.S. PATENT DOCUMENTS

| | | | |
|---|---|---|---|
| 692,217 | 1/1902 | Sundh | 200/67 |
| 2,795,671 | 6/1957 | Edwards | 335/32 |
| 3,109,905 | 11/1963 | Marquis | 335/127 |
| 3,238,341 | 3/1966 | Haydu | 200/243 |
| 3,263,042 | 7/1966 | Dyer et al. | 335/8 |
| 3,472,984 | 10/1969 | Cusick | 200/288 |
| 3,694,605 | 9/1972 | Quario | 200/250 X |
| 4,032,735 | 6/1977 | Butterworth | 335/132 X |

*Primary Examiner*—Steven M. Pollard
*Attorney, Agent, or Firm*—Hugh R. Rather; William A. Autio

[57] ABSTRACT

An electric power switch or contactor of the 3-pole AC type or the like is provided with means making it capable of withstanding higher fault currents such as short circuit currents. This is done by providing the insulating contact carrier with integrally molded stops that will allow the spring-biased bridging contacts to be blown slightly open by the high electro-dynamic forces occurring during high fault currents but will limit such opening of the contacts to gaps small enough to inhibit the arc from moving from between the contacts. Instead of attempting to keep the contacts closed under such conditions which would require a large magnetic force, allowing the contacts to open this small amount eliminates the need for a larger magnet, reduces the blow-open force and, more importantly, the small gaps will retain the arcs between the contacts and will inhibit them from flashing out to other parts of the contactor with consequent burning and destructive effect. As a result, the device will remain reusable with replacement of the contacts and possibly only minor repair.

4 Claims, 3 Drawing Figures

Fig. 1
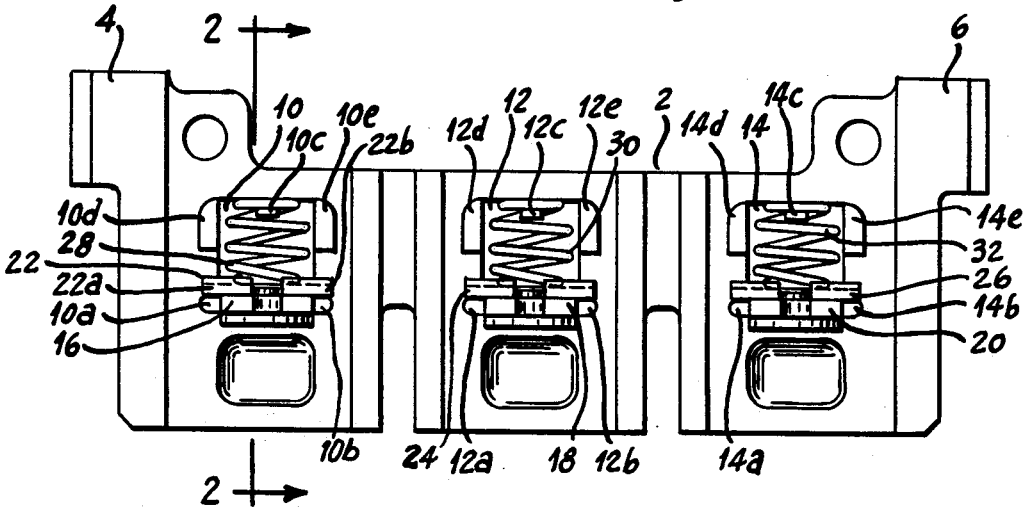
Fig. 2
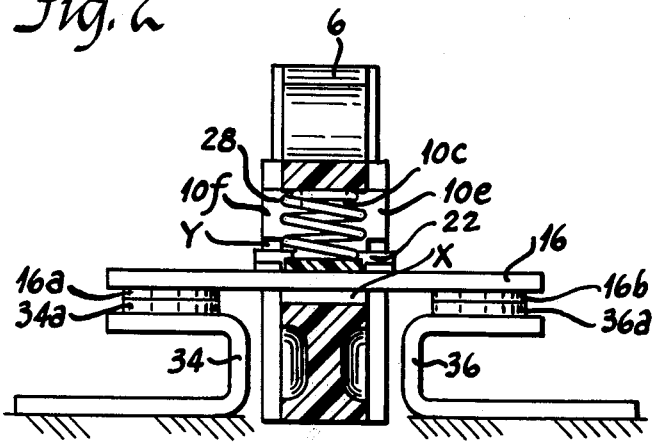
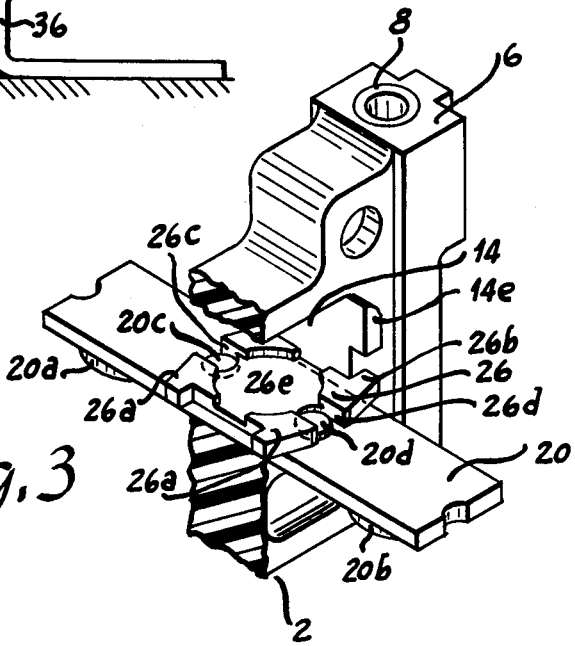
Fig. 3

CONTACTOR HAVING HIGHER FAULT CURRENT WITHSTANDABILITY

BACKGROUND OF THE INVENTION

High amperage fault currents have been known to occur in electrical power systems. Therefore, it has been the practice to incorporate in such systems protective apparatus capable of interrupting the circuit safely under such high amperage fault current conditions. Other control apparatus incorporated in such systems, such as switches or contactors, normally have not been capable of opening power circuits safely under overload or high fault current conditions, this being left to such protective apparatus designed for that purpose. To avoid destructive damage to such contactors, or switches, it has been the practice to provide special means for maintaining their contacts closed and to prevent their contacts from being blown open under high fault current conditions until the aforementioned protective apparatus has had time to operate to interrupt the circuit. Such special means for keeping the contacts closed under high fault current conditions have taken the forms of a larger operating magnet, mechanical latching means or the like. However, such approach has had the disadvantages of increasing the size of the magnet or requiring added latch components resulting in an increase in the size and cost of a contactor or switch. This invention relates to improvements thereover.

SUMMARY OF THE INVENTION

An object of the invention is to provide an improved electric switch.

A more specific object of the invention is to provide a contactor having higher fault current withstandability.

Another specific object of the invention is to provide a power control contactor or switch with improved means to confine the arcs between the contacts when they are blown open due to high fault currents.

Another specific object of the invention is to provide a contactor with stops for its movable contacts that will allow these movable contacts to be blown slightly open against the force of their bias springs under high fault current conditions but will limit such opening of these movable contacts to very small gaps to confine the arcs therebetween.

Another specific object of the invention is to provide the electrically-insulating contact carrier of an electric switch with integral stops that limit the blow-open of the contacts under fault or short circuit current conditions to gaps small enough to contain the arcs.

Other objects and advantages of the invention will hereinafter appear.

BRIEF DESCRIPTION OF THE DRAWINGS

FIG. 1 is a front elevational view of a contact carrier for a 3-pole contactor constructed in accordance with the invention and showing the integral stops that limit the blow-open movement of the contacts;

FIG. 2 is a cross-sectional view of the contact carrier taken substantially along line 2—2 of FIG. 1 together with a pair of stationary contacts of the contactor to show the closed condition of the contacts; and FIG. 3 is an isometric view of the contact carrier of FIG. 1 showing the contact retainer plate and movable contact in assembled position.

DESCRIPTION OF THE PREFERRED EMBODIMENT

Referring to FIG. 1, there is shown a contact carrier of an electromagnetic contactor. This type of contact support which carries the movable contacts is normally connected at its ends to the lower ends of a pair of pushbars that drive the contact carrier under the control of an electromagnet. Such pushbars may be guided in the contactor housing sides for vertical sliding movement and are spring-biased upwardly into normally-open contact position. The magnet armature engages these pushbars at their upper ends and drives them downwardly into contacts-closed position when the electromagnet is energized.

As shown in FIG. 1, contact carrier 2 is molded of electrically insulating material in generally elongated rectangular form having a mounting knob 4 at its upper left corner and a mounting knob 6 at its upper right corner and ribs and grooves in its surfaces to lengthen the electrical creepage paths between the poles. Each of these mounting knobs has a metal insert lined hole 8 vertically therethrough as shown in FIG. 3 through which a screw may be inserted to attach the contact carrier to the aforementioned pushbars.

This contact carrier is also provided with three equally spaced apart apertures or "windows" 10, 12 and 14 extending laterally therethrough in which movable bridging contacts 16, 18 and 20 are supported. Each such aperture is generally rectangular in shape except at the bottom of the aperture where it is wider by provision of slots **10*a* and 10*b*, 12*a* and 12*b* and 14*a* and 14*b* at opposite sides thereof as shown in FIG. 1** to enable assembly of a retainer plate therein as hereinafter described.

Contacts 16, 18 and 20 are held in their apertures by respective retainer plates 22, 24 and 26 and springs 28, 30 and 32. As shown in FIG. 3, movable contact 20 is a straight flat strip of metal having a pair of good electrically conducting metal such as silver contact elements **20*a* and 20*b* welded to its lower surface at its ends. Contact elements 16*a* and 16*b* of contact 16 are more clearly shown in FIG. 2. Each contact such as 20 is also provided with a pair of spaced apart round retaining nibs 20*c* and 20*d* symmetrically at its middle upper surface as shown in FIG. 3**. The other contacts are similar.

Retainer plate 26 shown most clearly in FIG. 3 is a generally flat plate having two pairs of wings **26*a* and 26*b* at its left and right edges for embracing the sides of the corresponding window 14 in the contact carrier bar 2. Retainer plate 26 is also provided with lateral notches 26*c* and 26*d* on its rear and front edges positioned to receive nibs 20*c* and 20*d* of the contact as shown in FIG. 3. Furthermore, retainer plate 26 is provided with a round recess 26*e* on its upper surface for retaining the lower end of spring 32. The other two retainer plates 22 and 24 are similar to plate 26. Each window in the contact carrier has a spring retainer nib 10*c*, 12*c* and 14*c***, integral with the contact carrier and extending down from the top of the window into the upper end of the associated compression spring.

To assemble the contact, the retainer plate such as 26 which is wider than its window by its wings **26*a* and 26*b* is first inserted into the window through slots 14*a* and 14*b* at the bottom thereof, that is, one wing of each pair 26*a* and 26*b* passes through slots 14*a* and 14*b* to the other side. This retainer plate is then lifted up in the window, its center part between the wings being narrow enough to rise up in the window. The contact such as 20 is then inserted into the window below the retainer plate and the retainer plate is lowered thereon so that nibs 20c and 20d of the contact enter notches 26c and 26d, respectively, to lock the contact to the retainer plate. The spring such as 32 is then compressed and inserted above the retainer plate in the window with its lower end retained in recess 26e and its upper end retained on nib 14c and released to expand therein. As a result, the contact spaces the retainer plate above slots 14a and 14b so that the retainer plate is locked in place by its pairs of wings 26a and 26b** embracing the edges of the window. And this retainer plate locks the contact by its nibs so that it cannot come out of the window. Both the contact and the retainer plate, however, can be pushed up in the window against the bias of the spring.

As shown in FIG. 2, spring 28 provides contact pressure for its associated contact 16 in addition to retaining the contact through the contact carrier. Thus, a pair of stationary contacts 34 and 36 are provided for each movable bridging contact as shown in FIG. 2. These stationary contacts are provided with good electrically conducting metal such as silver contact elements 34a and 36a and the stationary contacts are supported in the contactor housing so that their contact elements are positioned below the contact elements (such as 16a and 16b) of the associated movable bridging contact. Consequently, when the electromagnet is energized, the contact carrier 2 is moved downwardly closing the contacts as shown in FIG. 2 and compressing spring 28. This compression of the spring allows movable contact 16 in FIG. 2 to rise up from the bottom of its window by the distance marked X. With this arrangement, contact wear allowance is provided because even if the contact elements wear thinner, this spring pressure will keep the contacts tightly closed.

As an important aspect of the invention, means is provided for improving the fault current withstandability by limiting the amount that the contacts can be moved up in their windows against the force of their springs. This means comprises integrally molded ribs at the edges of the windows of the contact carrier that serve as stops for the pairs of wings on the retainer plate. Thus, window 10 has a pair of ribs 10d and 10e, one on each side of the window at the front of the contact carrier, and a similar pair of ribs similarly positioned at the rear of the contact carrier, rib 10f which is directly behind rib 10e being shown in FIG. 2. Window 12 is provided with a similar pair of ribs 12b and 12e, one on each side of the window at the front of the contact carrier, and a similar pair of ribs (not shown) similarly positioned at the rear of the contact carrier. And window 14 is provided with a similar pair of ribs 14d and 14e, one on each side of the window at the front of the contact carrier as shown in FIG. 1, and rib 14e being shown more clearly in FIG. 3, and a similar pair of ribs (not shown) similarly positioned at the rear of the contact carrier.

It will be seen in FIG. 2 that when the contacts are closed, retainer plate 22 is spaced from the lower ends of ribs 10e and 10f by a distance marked Y. Therefore, when the movable contacts are blown open under short circuit fault conditions, they can open only enough to close this space Y which is a few to several thousands of an inch. With respect to blow-open of contact 16 in FIG. 1, wings 22a and 22b of retainer plate 22 will stop against the lower ends of ribs 10e and 10f, and 10d and a similar rib opposite the latter, to stop the contact from opening further, and similarly with respect to movable contacts 18 and 20. Thus, there will be only small gaps between contact elements 16a-34a and 16b-34b and similarly with respect to the other two sets of contact elements. This will cause arcs to occur between the contact elements, but limiting the contact opening gaps in this manner will substantially confine or retain the arcs between the contacts thereby preventing the arcs from being blown away from the contacts onto other parts with consequent burning and damage thereto. While the contact elements or contacts may burn under such conditions, they are replaceable at relatively small cost and the contactor remains usable. Consequently, this structure enhances substantially the fault current withstandability of the contactor.

Generally, the motion of arcs between adjacent contact surfaces is controlled by a relationship between arc gap and current level for a particular contact construction and material. Depending on the contact construction, there is a limiting gap below which an arc is inhibited from moving from between the contacts with a given current magnitude. This invention applies the principle of maintaining the arc gap during short circuit or high current conditions below this minimum gap length.

As an example, tests show that with an arc gap limited to 0.060 of an inch, and a current of 45,000 amperes, excessive damage caused by arcs moving from between the contacts during magnetic repulsion time was significantly diminished.

The invention disclosed controls the amount of energy dissipated and confines the arcs to the area between the contacts. At a given fault current, the energy being dissipated is approximately proportional to the contact gap, or:

$$\text{Energy} \approx I(Vm + kl)$$

where I is current, Vm is the minimum arc voltage, l is the length of the arc gap, and k is a constant. Therefore, limiting the contact gap as hereinbefore described keeps the arcs immobile and results in controlled burning of the contacts rather than uncontrolled destruction of the contactor that would otherwise occur.

The blow-apart force that causes opening of the contacts has the following relation:

$$F = KI^2 \ln D/d$$

where F is the blow-apart force, K is a constant related to the particular structure, I is the fault current flowing through the contacts, D is the diameter of the contacts, and d is the diameter of either the arc or the current constriction when contacts are closed. It will be apparent that when the contacts are closed, d will be small because current flows only through high points of the contacts that touch. When the contacts are blown apart, d increases greatly because now the arc current flows through a large area of ionized gaps and arc products. As a result, the logarithm of D/d decreases toward 1 thereby reducing force F.

While the blow-open force may be decreased as a result of the contacts opening the small amount indicated above, the important effect is that the arcs are confined between the contacts to prevent damaging the entire contactor under fault current conditions.

While a 3-pole contactor contact carrier has been used for illustrative purposes, it will be apparent that the invention is applicable to contactors and electric switches having different numbers of poles of either the double-break bridging contact type or single break contact type and of either the electromagnetic or mechanical closed types or the like.

While the apparatus hereinbefore described is effectively adapted to fulfill the objects stated, it is to be understood that the invention is not intended to be confined to the particular preferred embodiment of contactor having higher fault current withstandability disclosed, inasmuch as it is susceptible of various modifications without departing from the scope of the appended claims.

We claim:

1. An electric switch having higher fault current withstandability comprising:

stationary contact means;

movable contact means;

and operating means for closing said movable contact means with respect to said stationary contact means comprising:

an electrically insulating contact carrier and means coupling the same to said operating means for movement thereby;

and supporting means comprising resilient means supporting said movable contact means on said contact carrier so as to cause stressing of said resilient means when the movable contact means close thereby to afford adequate contact pressure and wear allowance:

and means providing said switch with higher fault current withstandability comprising auxiliary stop means incorporated in said contact carrier effective upon blow-open of said contact means under high fault current conditions which causes opening movement of said movable contact means relative to said supporting means and further stressing of said resilient means causing arc currents to flow for limiting said opening movement of said movable contact means to an amount that slightly exceeds the full wear allowance and is effective to confine said arc currents between said contact means and keep the gap therebetween small enough to control the rate of energy dissipation and reduce serious arc damage to other parts of the switch.

2. An electromagnet contactor having higher fault current withstandability comprising:

stationary contact means;

movable contact means;

and electromagnetic means operable to close said movable contact means with respect to said stationary contact means comprising:

an electrically insulating contact carrier and means coupling the same to said electromagnetic means for movement thereby;

supporting means comprising biasing spring means supporting said movable contact means on said contact carrier so as to allow movement of said movable contact means against the force of said biasing spring means when the movable contact means close thereby to afford adequate contact pressure and wear allowance;

and auxiliary stop means providing higher fault current withstandability comprising means operable when said movable contact means are blown open under high fault current conditions which causes opening movement of said movable contact means relative to said supporting means further against the force of said biasing means causing arc currents to flow between said contact means for restricting contact opening to a range between a minimum gap slightly outside the point of full wear allowance on new contacts and varying with contact wear to a maximum gap of slightly more than the wear on worn contacts so as to confine said arc currents between said contact means and thereby to reduce significant arc damage to other parts thereof.

3. A contactor for controlling an electric circuit and having higher fault current withstandability comprising:

a pair of spaced stationary contacts;

a movable bridging contact adapted to connect said spaced stationary contacts when moved into engagement therewith;

and actuating means for moving said movable bridging contact selectively into and out of engagement with said stationary contacts comprising:

an electrically insulating contact carrier having an aperture laterally therethrough with said movable bridging contact extending through said aperture;

a retainer within said aperture retaining said movable bridging contact against lateral movement out of said aperture while permitting vertical movement within said aperture;

and a bias spring within said aperture biasing said movable bridging contact downwardly within said aperture while allowing forced movement thereof upwardly against the force of said spring in response to movement of said contact carrier downwardly beyond the point where said movable bridging contact first touches said stationary contacts;

and means incorporated in said contact carrier that provides said contactor with enhanced high fault current withstandability comprising integral ribs at the edges of said aperture forming stops that limit the blow-open movement of said movable bridging contact against the force of said spring to a gap small enough to substantially inhibit the arcs from moving from between the contacts and thereby to reduce any arc-burning damage to other parts of the contactor.

4. The contactor claimed in claim 3, wherein:

said aperture has a substantially uniform width with the exception of lateral slots at the lower sides thereof providing it with a wider dimension thereat;

and said retainer is provided with two pairs of wings, one wing of each pair being adapted to slide through said slots in assembly whereafter lifting said retainer in said aperture causes both pairs of said wings to embrace the sides of said aperture to retain the same therein;

and means on said retainer locking with said movable bridging contact when the latter is inserted into said aperture below said retainer.

* * * * *